United States Patent [19]

Saito

[11] 4,392,302

[45] Jul. 12, 1983

[54] METHOD OF MANUFACTURING A MOVABLE CONTACT MEMBER

[75] Inventor: Shigemasa Saito, Gyoda, Japan

[73] Assignee: Fuji Electric Company, Ltd., Kanagawa, Japan

[21] Appl. No.: 219,992

[22] Filed: Dec. 23, 1980

[30] Foreign Application Priority Data

Dec. 31, 1979 [JP] Japan ..... 54-172073

[51] Int. Cl.[3] ..... H01R 43/02

[52] U.S. Cl. ..... 29/879; 29/876

[58] Field of Search ..... 29/876, 879, 878, 622; 51/80 A; 72/40; 148/154, 11.5 C, 12.7 C, 13.2

[56] References Cited

U.S. PATENT DOCUMENTS

| | | | |
|---|---|---|---|
| 2,318,432 | 5/1943 | Stanier et al. | 72/40 X |
| 2,527,983 | 10/1950 | Brown et al. | 148/12.7 C |
| 3,229,357 | 1/1966 | Burstin | 29/879 |
| 3,332,140 | 7/1967 | Sugiura et al. | 29/622 X |
| 3,531,861 | 10/1970 | Golbeck | 29/622 |

FOREIGN PATENT DOCUMENTS

| | | | |
|---|---|---|---|
| 1183880 | 3/1970 | United Kingdom | 148/154 |

OTHER PUBLICATIONS

*ASM Metals Handbook* (1961 ed.) vol. 1, pp. 962, 1037.
*Insulation Circuits* Oct. 1976, pp. 29–32.
*Understanding Copper Alloys* ed. by J. Howard Mendenhall (1977) p. 36.
Formability of Be-Cu vs Other Cu Base Alloys by K. Wikle and C. Harlan, Kawecki Berylco Ind. Inc.

*Primary Examiner*—Carl E. Hall
*Assistant Examiner*—Carl J. Arbes
*Attorney, Agent, or Firm*—Brumbaugh, Graves, Donohue & Raymond

[57] ABSTRACT

A contact member for a switching device is formed by soldering a contact tip to a movable contact member. The movable member is formed from an age-hardenable copper alloy that has been subjected in series to solution treatment, half age-hardening, grinding and rust-prevention coating.

6 Claims, 5 Drawing Figures

FIG. 3
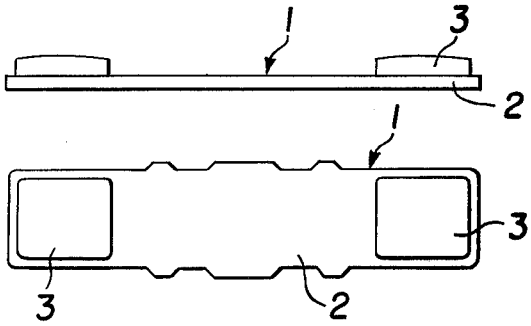
FIG. 4
FIG. 5
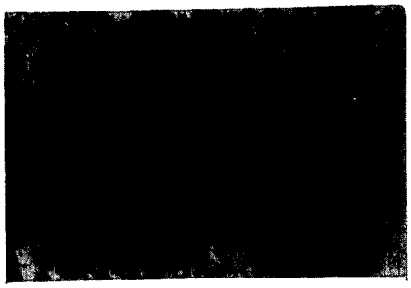

METHOD OF MANUFACTURING A MOVABLE CONTACT MEMBER

BACKGROUND OF THE INVENTION

The present invention relates to a method of manufacturing a movable contact member to be used in equipment such as electromagnetic switches, which member must have great fatigue strength and low hardness. This contact member is also required to be capable of bearing a large current overload, light in weight, chemically stable, capable of good bonding and adequately elastic.

Known techniques to satisfy such requirements include (1) using special alloys, (2) using copper alloys (inclusive of their casting and heat treatment), (3) forming the member in a rather complicated shape so as to provide stiffening, and (4) forming the member by bonding different kinds of alloys with each other. Of those known techniques, the one using a movable contact member comprising a flat spring of age-hardenable copper alloy, such as beryllium-copper-25 alloy (Be Cu 25), with a contact tip bonded to it, has been particularly widely utilized because it results in a simple construction, high electrical conductivity and high mechanical strength.

With that method, however, it is necessary to perform a batch process, age-hardening treatment in a furnace (e.g. at 315° C. for 3 hours) after the step of bonding the contact tip to the flat spring with silver solder. Consequently, some deformation of the product can be caused by heat, so that an additional process (i.e. flattening) is required to correct its shape. Also, this known technique of manufacturing the movable contact member has a disadvantage in that a solid oxide film is formed on the surface of the material in a step usually referred to as "solution treatment". Such an oxide film causes inadequate bonding during the step of soldering the contact tip with that material. Consequently, it is necessary to remove that oxide film by pickling the material before the bonding step, which complicates the manufacturing process.

A further disadvantage of this known technique of manufacturing the movable contact member is that anti-corrosive surface treatment cannot take place before the age-hardening treatment because the heating during the age-hardening treatment would remove the anti-corrosive coating produced by that surface treatment. Since the anti-corrosive surface treatment cannot be done until late in the manufacturing process, a chemical change can occur on the material surface in the earlier stages of the manufacturing process. Still another disadvantage of this known contact member appears during its operation. In particular, its preparation with the age-hardening treatment (e.g. 315° C., 3 hours) results in its structure being excessively age-hardened. This can cause some change in its dimensions during operation if a large current overload occurs in the contact member. Due to the current its temperature can rise over that of the temperature in the age-hardening treatment such that there is a change of its dimensions that can result in faulty performance.

The contact tip used in the contact member is usually made of an expensive material such as silver alloy. It is therefore required that the consumption of the material of the contact tip be minimized in actual operation, in order to obtain a low-cost product. Most of the consumption of the contact tip material occurs due to arcs that appear when contact members part from each other. Such arcs, however, are produced not only upon the breaking of the contact, but also due to bouncing motions of the movable contact member upon closing. If heavy bouncing motions occur, they can not only cause a reduction in the life of the contact members, they can even cause a worst phenomenon, such as the sticking of the contacts together due to melting. It is therefore necessary to minimize those bouncing motions as far as possible. In case the movable contact member is coupled to a movable contact member holder by the force of a spring, the duration t of the bouncing motions is given by $$t = K\frac{\epsilon_s}{1-\epsilon_s}$$

where K is a constant (determined by ratings of the contact, such as the rated voltage and the weight of the movable part), and $\epsilon_s$ is a mechanical constant of the movable contact member relating to its recoil capability. In order to reduce the consumption of the contact tip material, it is desirable to shorten the duration t, that is, to reduce the value of $\epsilon_s$. Such a reduction in $\epsilon_s$ can be obtained by reducing the hardness of the movable contact member material. But in the case of the above-described and known contact member, reducing its hardness causes a disadvantage, in that its fatique strength drops.

SUMMARY OF THE INVENTION

The object of the invention is to provide a method of manufacturing a movable contact member having a large fatigue strength with less hardness. This is accomplished by the elimination of the typical age-hardening treatment after the bonding of the contact tip to the contact member. Also further objects of the invention are to shorten the manufacturing process, to improve the durability in terms of accuracy of the dimensions of the product, and to increase the life of the contact tip by a reduction of the duration of the bouncing motions during closure, so that a superior low-cost movable contact member can be produced.

According to the invention these objects are obtained by using an age-hardenable copper alloy, after solution treatment, as the material of the flat spring. This material is subjected to a continuous process comprising the steps of half age-hardening, grinding, and treatment for rust prevention. After that the contact tip is bonded to the flat spring.

BRIEF DESCRIPTION OF THE DRAWINGS

The foregoing and other features of the present invention will be more readily apparent from the following detailed description of an illustrative embodiment of the invention presented in conjunction with the attached drawings, wherein:

FIG. 3 is a side view of an embodiment of the movable contact member produced by the invention;

FIG. 4 is a plan view of an embodiment of the movable contact member produced by the invention; and FIG. 5 is a photomicrograph (160 power magnification) of the metallurgical structure of the contact member.

DESCRIPTION OF AN ILLUSTRATIVE EMBODIMENT

Figure 1:
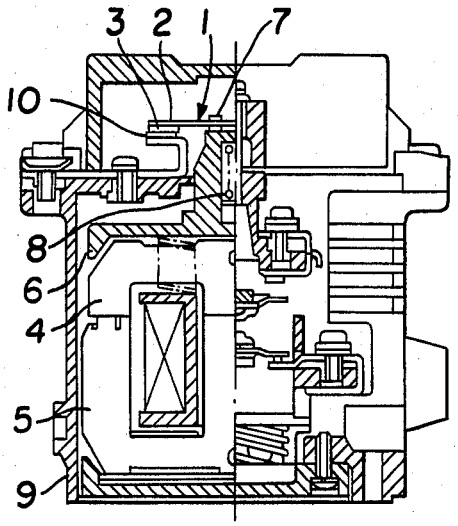
FIG. 1 is a sectional view showing an electromagnetic switch in which a movable contact member according to the invention is assembled.
Figure 2:
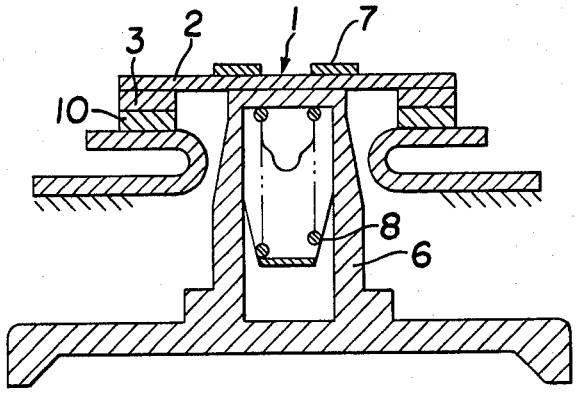
FIG. 2 is an enlarged partial sectional view of FIG. 1 in the vicinity of the movable contact member.

FIG. 1 shows an electromagnetic switch apparatus for which the invention is typically applicable. In FIG. 1 reference numeral 1 denotes the movable contact member which comprises a flat spring 2 and a contact tip 3 bonded to the spring 2 by soldering. When an electromagnet comprising parts 4 and 5 produces a pulling action, the action is transmitted through a movable contact member holder 6, a contact spring 8 and a fixture 7 to the movable contact member 1. As a result, this member 1 moves to abut a stationary contact member 10 which is mounted to a frame 9 of the electromagnetic switch. The movable contact member 1 is pressed against the holder 6 by the force of contact spring 8 as shown in FIG. 2. The electromagnetic switch may, for example, be one having a rated voltage of 220 volts, a normal current of 26 to 35 amperes and a rupturing capacity of about 500 amperes.

In order to form the flat spring 2, a metallic material is subject to a continuous process comprising in series the steps of half age-hardening, grinding and rust-preventative filming, while the material is held in the shape of a long hoop. After the continuous process, the treated material is stamped, to form the flat spring, and soldered to the contact tip 3 (FIG. 3) and FIG. 4. The material used in the continuous process is an age-hardenable copper alloy, such as $BeCu_{25}$ or the like, which has been subjected to a customary type of solution treatment (for example, at 765° C. for 1 hour).

The half age-hardening treatment step can be accomplished, for example, by passing the material through a heating furnace at 550° C. while traveling at an adequate speed, such as 0.5 m/min for a 0.6 mm thick material, whereby each portion of the material is subject to heating for about 30 sec.

The grinding operation is carried out in order to remove the oxide film produced in the solution treatment. It can usually be accomplished by passing the material between two rollers. In order to obtain good grinding results, the rollers perferably have a peripheral speed slightly different than the feed speed of the material.

The rust-preventing treatment is intended to prevent rust during storage and to facilitate shearing without a lubricant. It can be attained by passing the material through a bath of benzotriazole rust-preventing agent.

Contact tip 3 is bonded to the prepared flat spring 2 to complete the construction of the movable contact member 1. Bonding of the contact tip 3 to the spring 2 can be carried out with induction heating or resistance heating at a temperature between 600° C. and 750° C. for a duration between 1.0 sec. and 7 sec. In a preferred embodiment silver solder is used with induction heating at 670° C. for 4 sec. In this context, it is important to attain partial heating so that the physical quality of the flat spring 2 is not deteriorated.

The movable contact member 1 produced, as described above, from material containing the components listed in Table 1, has the mechanical characteristics listed in Table 2.

TABLE 1

| | (% in weight) | | |
|---|---|---|---|
| BE | Ni + Co | Ni + Co + Fe | Cu + Be + Co + Fe |
| 1.8 ~ 2.0 | 0.20 | 0.6 | 99.5 |

TABLE 2

| Tensile strength ($kg/mm^2$) | Elongation (%) | Hardness (Hv 0.5) | Fatigue strength ($Kg/mm^2$) |
|---|---|---|---|
| 75 ~ 90 | 20 ~ 25 | 220 ~ 270 | 36 ~ 42 |

Consequently, it can be seen that the movable contact member produced according to the invention has great mechanical strength, similar to previously known ones, but has reduced hardness, i.e. in the range of 220 to 270 (Hv0.5). Furthermore, the elongation percentage is between 20% and 25%, whereby its operational performance is accomplished with less bouncing motions, so as to minimize the consumption of contact tip material. This feature of large strength with low hardness is caused by the metallurigical structure of the contact member, which in turn is due to its being half age-hardened by precipitation of Be. FIG. 5 is a microscopic photograpbh (160 power in magnification) showing this metallurgical structure of a movable contact member manufactured according to the invention. Such a metallurgical structure can be obtained only when there is no age-hardening treatment after the bonding of the contact tip, i.e. where the age-hardening treatment is employed only before the bonding step.

As a result of the present method, the product of the invention has none of the excessively age-hardened structures which appear in products manufactured by previously known methods. Therefore, the product of the invention does not have any appreciable change of its dimensions during excessive current conditions. Table 3 shows the results of a comparative test of the dimensional accuracy of a movable contact member according to the invention, after a current overload, in comparison with a similar product of a previously known manufacturing method. The comparison was made after a current of 200 amperes was passed through the members 100 times.

TABLE 3

| | |
|---|---|
| Customary product (with age-hardening at 315° C., 3 hours) | 0.83 mm ~ 0.9 mm |
| Product of the invention (with half age-hardening as above) | 0.27 mm ~ 0.22 mm |

During the method of the invention, which does not use the heavy age-hardening treatment of the previous methods which are carried out at 315° C. for 3 hours, there can be no thermal deformation of the product caused by heating. Consequently no flattening step is required. Also the grinding step in the present invention is a very simple one, so that the pickling treatment, which is required in the known technique in order to remove the oxide film, is not required. Further, since the rust-preventative treatment is carried out before the stamping step and the bonding of the contact tip to the contact member, there can be no chemical change on the product surface in the manufacturing process.

As mentioned above, the invention uses age-hardenable copper alloys that have been solution treated, as the material of the flat spring. This material is subjected to a continuous process comprising half age-hardening, grinding and rust-preventative treatment, so as to form the flat spring. The contact tip is then bonded to the spring in such a way that no deterioration of the product can be caused. Thus, the movable contact member has adequate mechanical strength with less hardness and can be produced in a much shortened manufacturing process (shortened by about 45%) from that of previously known methods. The product has superior strength against current overloads and is of low-cost, due to the use of only a small quantity of the contact tip material.

It is of course possible to use the invention not only for the movable contact member of electromagnetic switches, but for other equipment, such as control relays and various other switching apparatus.

I claim:

1. A method of manufacturing a movable contact member formed from a flat spring and a contact tip bonded to it, which comprises the steps of:

age-hardening to a one-half hard temper a solution-treated age-hardenable copper alloy that is to be used as the material of the flat spring, grinding the surface of the age-hardened spring material, applying a rust-preventing film to the spring material, and bonding the contact tip to the spring material.

2. The method as set forth in claim 1, wherein the grinding is carried out by passing the material between two rollers.

3. The method as set forth in claim 2, wherein the peripheral speed of the rollers is slightly different from the feed speed of the material.

4. The method as set forth in claim 1, wherein the rust-preventing film treatment is carried out by passing the material through a solution of benzotriazole rust-preventing agent.

5. The method as set forth in claim 1, wherein the bonding of the contact tip to the flat spring is carried out by soldering with induction heating.

6. The method as set forth in claim 1, wherein the age-hardenable alloy is beryllium copper 25 and the age-hardening takes place at a temperature of approximately 550° C. in a heating space and at such a traveling speed of the material through the heating space that each portion of the material is subjected to heating for about 30 seconds.

* * * * *